United States Patent [19]

Lavery

[11] Patent Number: 4,487,311

[45] Date of Patent: Dec. 11, 1984

[54] DUAL COMPARTMENT DISPLAY CARTON

[75] Inventor: John J. Lavery, Chicago, Ill.

[73] Assignee: International Paper Company, New York, N.Y.

[21] Appl. No.: 484,808

[22] Filed: Apr. 14, 1983

[51] Int. Cl.[3] ..... B65D 25/00

[52] U.S. Cl. ..... 206/45.31; 229/27; 229/15

[58] Field of Search ..... 229/27, 28 R, 15; 206/45.31

[56] References Cited

U.S. PATENT DOCUMENTS

| | | | |
|---|---|---|---|
| 2,789,689 | 4/1957 | Lewis | 206/45.31 |
| 2,913,101 | 11/1959 | Daily | 206/45.19 |
| 2,970,738 | 2/1961 | Strange | 229/27 |
| 2,983,421 | 5/1961 | Turpin | 229/27 |
| 3,186,622 | 6/1965 | Palmer | 229/27 |
| 3,233,726 | 2/1966 | Gero | 229/27 |
| 3,510,046 | 5/1970 | Reiner | 229/27 |
| 3,685,640 | 8/1972 | Tolaas | 206/44.11 |
| 3,804,321 | 4/1974 | Forbes, Jr. | 229/38 |
| 4,111,299 | 9/1978 | Taub | 229/27 |
| 4,342,417 | 8/1982 | Forbes, Jr. | 229/27 |

*Primary Examiner*—Joseph Man-Fu Moy
*Attorney, Agent, or Firm*—Richard J. Ancel

[57] ABSTRACT

A dual compartment display carton formed, by folding and gluing, into a generally parallelepiped shape. Each product cell is adapted to hold a plurality of stacked items, such as cups and cup holders. The two product cells are fixed together along a common boundary wall. One product cell is partially open and the other may be completely closed against contaminants by a transparent plastic sheet.

5 Claims, 4 Drawing Figures

DUAL COMPARTMENT DISPLAY CARTON

This invention relates to a display carton in the form of a parallelepiped and is fashioned from a one piece blank of stiff, foldable and resilient sheet material such as paperboard. One of the two product display apertures of the carton, associated respectively, with each of two product cells, may be covered, if desired, with a transparent plastic sheet to protect items in that product display cell from dust and other contaminents.

The carton forming blank is suitably cut, folded and glued to form a display carton having two product cells, each cell being associated with a respective display aperture. One display aperture is formed from adjacent openings at meeting panels of the carton, while the second display aperture is formed on one panel only of the carton. In the embodiment illustrated and described, the second display aperture is in the same panel as one of the noted meeting panels.

One wall of one of the product cells is secured, over at least a part of one surface thereof, to one wall of the other product cell as by an adhesive. One of the product cells is partially defined by extended panels of the blank, the other product cell is partially defined by a bent back strip defined by two somewhat parallel cuts in the blank. One of the extended panels being secured to a portion of the bent back strip, the two product cells are thus joined to each other, thereby affecting a more rigid product cell construction than known in the prior art.

Known constructions of dual compartment display cartons, such as shown in U.S. Pat. No. 2,913,101 issued to Daily, define two product cells. The cells are however not directly secured to each other, and hence shock or impact forces on the items in the two product cells may cause undesired movement between the cells. By the construction of this invention, greater intercell rigidity and strength is realized.

IN THE DRAWINGS

Figure 1:
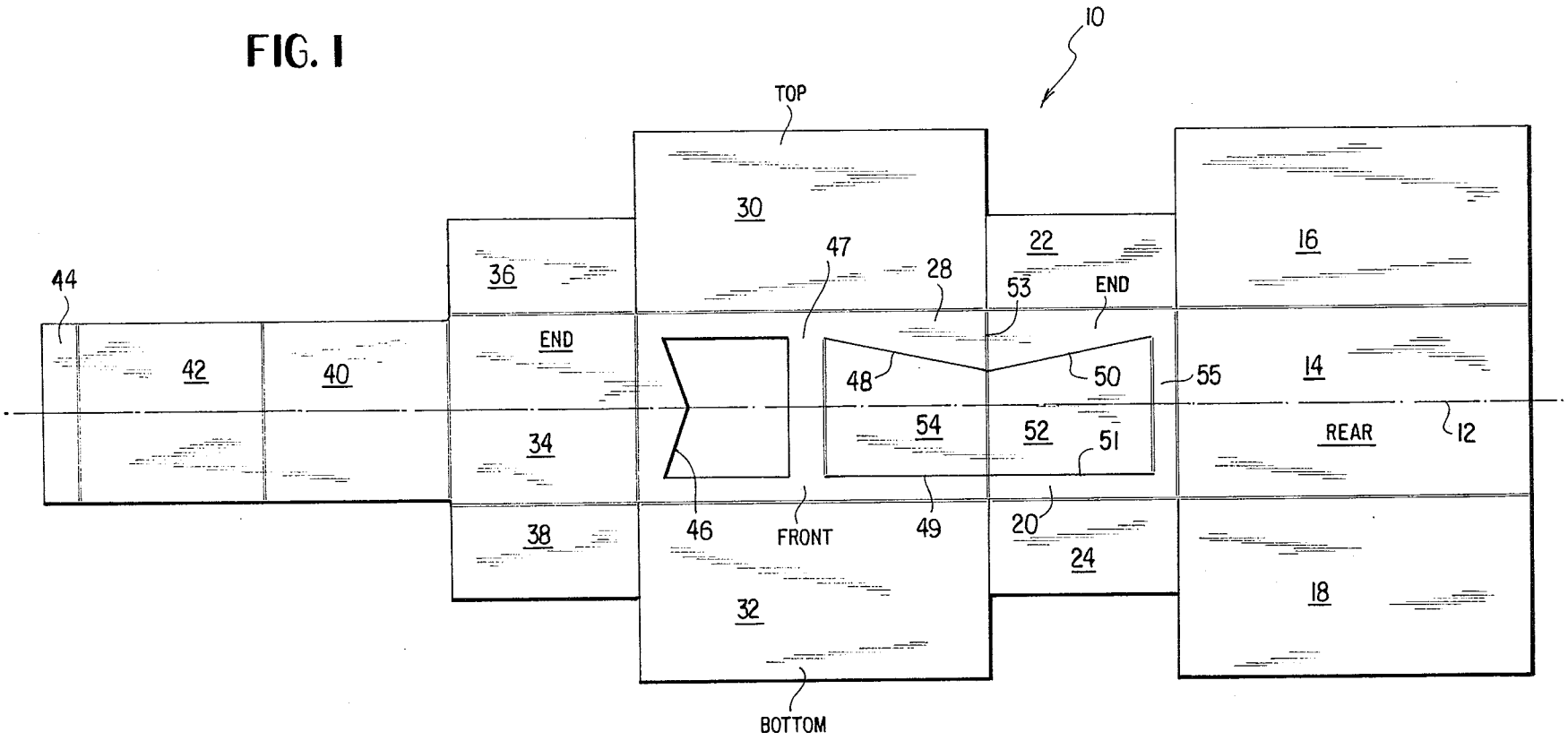
FIG. 1 is a plan view of the cut and scored blank from which the display carton of this invention is formed.

Referring now to FIG. 1 of the drawings, the numeral 10 denotes generally the cut and foldable blank form which the display carton of this invention is formed. The blank is formed of paperboard or other stiff, resilient and foldable material. The numeral 12 denotes an imaginary longitudinal axis of the blank. The numeral 14 denotes a rear panel, the numeral 20 denoting one end panel, the numeral 28 denoting the front panel, the numeral 34 denoting the other end panel, with numerals 40 and 42 denoting compartment panels and numeral 44 denoting a glue flap. It will be seen that these panels are serially connected to each other in the order recited. The connection between each panel is denoted, as conventional, by double lines, the double lines denoting a fold or hinge connection. Rear panel 14 is foldably connected to top panel 16 at its upper edge, and to bottom panel 18 at its lower longitudinal edge.

Similarly, end panel 20 is provided at its upper longitudinal edge with top panel 22 and at its lower longitudinal edge with bottom panel 32. The remaining end panel 34 is likewise provided with top and bottom panels hingedly connected thereto, these being denoted, respectively, by the numerals 36 and 38. The solid lines between the several top and bottom panels denote cut lines, i.e., the blank 10 is completely cut through at these regions. The reader will understand that the adjectives top and bottom as applied to panels 16 and 18, for example, refer to the orientation shown at FIG. 1, for convenience of explanation.

Front panel 28 is provided with a cut-out aperture 46. The numeral 47 denotes the central region of front panel 28. Cut lines 48 and 49, somewhat parallel, extend from a fold line at the right side of region 47. Similar cut lines 50 and 51 run towards edge fold 53, to thereby define a first compartment panel 52, with the first mentioned cut lines 48 and 49 defining a second compartment panel 54. Portion 55 of end panel 20 defines the right end of first compartment panel 52, this right end defined by a fold line.

To assemble the blank of FIG. 1, the panels 14, 20, 28 and 34 are folded along the vertically extending hinge or fold lines joining them, to form a tube type structure. Compartment panel 40, termed a third compartment panel, and compartment panel 42, termed a fourth compartment panel, along with the glue panel 44, are folded to assume a position interiorly of a tube, as will be described in detail below. The top closure flaps 16, 22, 30 and 36 are folded, conventionally, to close the top of the tube, while a similar folding operation occurs with the bottom closure flaps 18, 24, 32 and 38 to close the bottom of the tube.

Figure 2:
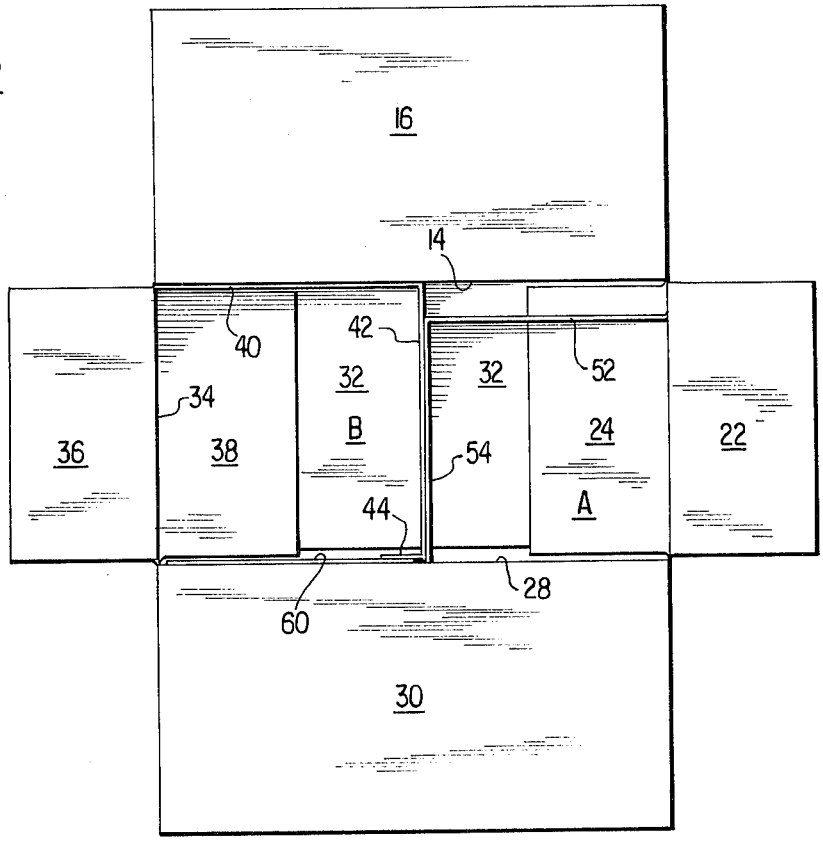
FIG. 2 is a top plan view of the assembled display carton of this invention, showing the interior construction of the carton with the top closure flaps being bent out at right angles to the upstanding walls of the carton.
Figure 3:
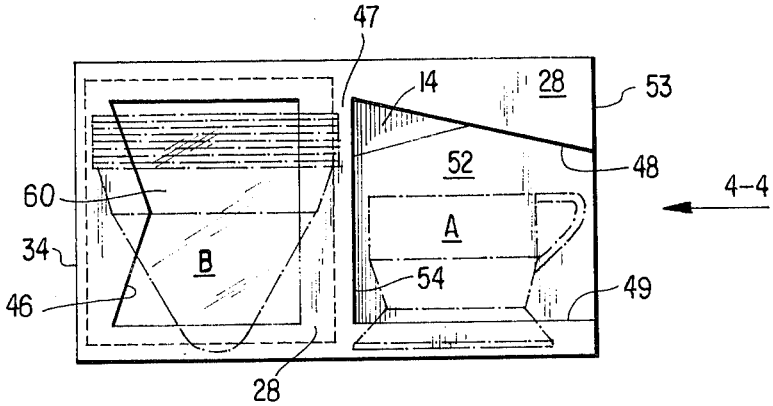
FIG. 3 is a front elevational view of the display carton of this invention in the fully closed position.
Figure 4:
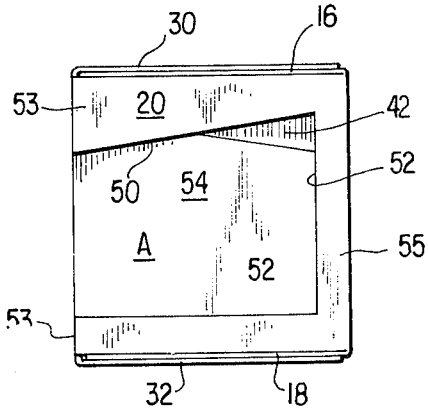
FIG. 4 is an end elevational view looking at the carton of FIG. 3 in the direction of the arrow 4—4 of FIG. 3.

As may be seen now with reference to FIG. 2 of the drawings, the interior construction of the carton is as follows. Third compartment wall 40 is adhered, as by glue, to a portion of rear wall 14. Fourth compartment panel 42 extends from rear panel 14 to front panel 28, with glue panel 44 being glued to one surface of a transparent plastic sheet denoted by the numeral 60, as indicated at FIGS. 2 and 3. Transparent sheet 60, preferably formed of a transparent plastic material, is affixed as by an adhesive to the interior periphery of aperture 46. Glue panel 44 then may be glued to a portion of the transparent window, with a portion of the glue panel 44 being optionally adhered to front panel 28. The reader will understand that the presence of transparent window 60 is for the purpose of protecting the contents of one of the two product cells of the display container, and may be omitted if desired. The strip defined by first and second compartment panels 52 and 54 is bent back into the interior of the container, to assume the position indicated at FIG. 2. One opening in the front panel and one adjacent opening (along fold line 53) in end panel 20 is defined by the bent back strip 52, 54. Second compartment panel 54 and third compartment panel 42 are at least partially glued together over their facing surfaces, for the purpose of imparting rigidity to the carton and to inhibit relative movement between the cells. For convenience, the first product cell is denoted by A, with the second product cell denoted by B. The first product cell is partially defined by first and second compartment panels, while the second compartment cell is partially defined by third and fourth compartment panels 40 and 42.

FIG. 3 is a front elevational view of the carton in its closed position, with the periphery of transparent sheet 60 being illustrated by the dashed lines.

In one intended use of the display carton of this invention, product cell A carries a pair of nested plastic holders, particularly adapted for holding plastic cups. Product compartment B carries a plurality of stacked or nested plastic cups of generally circular pyramidal form. One type of such a cup is marketed under the brandname Cozy. A cup holder in compartment A and two nested plastic cups are indicated in FIG. 3 by dashed lines.

It is claimed:

1. A one piece blank for forming a display carton, the blank formed of foldable stiff and resilient material such as paperboard, the blank including, a rear panel, a first end panel, a front panel, and a second end panel, each of said panels being serially foldably connected to each other in the order recited, the front, rear, and two end panels each provided at their respective upper and lower edges with top and bottom closure forming panels foldably connected thereto, a first compartment panel defined by two cut lines in an end panel, a second compartment panel defined by two cut lines in the front panel, respective cut lines in the first and second compartment panels meeting at a fold line between the front panel and that end panel which carries the second compartment panel, the improvement comprising, a third compartment panel, a fourth compartment panel, and a glue panel, the third compartment panel, the fourth compartment panel and the glue panel being serially foldably connected to each other in the order recited, the third compartment panel being serially connected to the said second end panel, the first and second compartment panels adapted to partially define a first product cell, the third and fourth compartment panels adapted to partially define a second product cell and the fourth compartment panel being adapted to be in surface contact with and affixed to at least a portion of the second compartment panel when the blank is folded and glued to form a tube type container closed at its top and bottom and being in the general form of a parallelepiped.

2. The blank of claim 1 wherein the front panel is provided with a product display aperture, the product display aperture adapted to make visible the contents of the second product cell.

3. A display carton formed of a single blank of stiff, resilient, and foldable material such as paperboard, the carton being of the tube type and closed at its top and bottom by closure flaps, the carton having front, end, and rear panels, each of said panels foldably carrying a top closure panel at its upper edge and a bottom closure panel at its lower edge, first and second compartment panels folded into the carton interior from respectively, one end panel and the front panel, to thereby partially define a first product cell having one opening in an end panel and one opening in the front panel, the openings meeting along an edge of the display carton, the improvement comprising, the other end panel foldably connected to a third compartment panel, the third compartment panel foldably connected to a fourth compartment panel, a glue panel serially connected to the fourth compartment panel, the third compartment panel fixed over one surface thereof to a portion of the rear panel, the fourth compartment panel extending between the front and rear panels and orthogonal to them and being in surface contact with and affixed to at least a portion of the second compartment panel, the glue panel affixed to the front panel, whereby the third and fourth compartment panels partially define a second product cell.

4. The display carton of claim 3 wherein front panel is provided with a display aperture in the front panel to thereby make visible the interior of the second product cell.

5. The display carton of claim 4 including a plurality of stacked, nested items in at least one of the two product cells.

* * * * *